US008973163B1

(12) United States Patent
Kuever et al.

(10) Patent No.: US 8,973,163 B1
(45) Date of Patent: Mar. 10, 2015

(54) INFANT CAREGIVER PROTECTIVE GARMENT HAVING AN ATHLETIC SHOULDER PAD APPEARANCE

(71) Applicants: Linda A. Kuever, Lake Forest, IL (US); Roy W. Kuever, Lake Forest, IL (US)

(72) Inventors: Linda A. Kuever, Lake Forest, IL (US); Roy W. Kuever, Lake Forest, IL (US)

( * ) Notice: Subject to any disclaimer, the term of this patent is extended or adjusted under 35 U.S.C. 154(b) by 0 days.

(21) Appl. No.: 13/784,324

(22) Filed: Mar. 4, 2013

Related U.S. Application Data

(60) Provisional application No. 61/636,235, filed on Apr. 20, 2012.

(51) Int. Cl.
*A41D 27/12* (2006.01)
*A41D 13/04* (2006.01)

(52) U.S. Cl.
CPC ..... *A41D 13/04* (2013.01)
USPC ..... 2/46

(58) Field of Classification Search
CPC ... A41D 1/205; A41D 13/0012; A41B 13/10; Y10S 2/913
USPC ..... 2/46, 48, 102, 459, 461, 462
See application file for complete search history.

(56) References Cited

U.S. PATENT DOCUMENTS 2,417,888 A * 3/1947 Schuster ..... 2/104
2,439,082 A * 4/1948 Emmey et al. ..... 40/638
2,468,841 A 5/1949 Siegel
2,563,420 A 8/1951 Roe
2,763,870 A 9/1956 Mitchell
2,802,216 A 8/1957 Vogel
2,808,589 A 10/1957 Tyroler
2,858,545 A 11/1958 Silverman
2,902,695 A 9/1959 Werner
2,986,738 A 6/1961 Zubiate
3,083,372 A 4/1963 Filiatreau, Sr.
3,144,657 A 8/1964 Groot
4,285,067 A 8/1981 David
4,411,025 A 10/1983 Magidson
D284,516 S 7/1986 Dyer
4,651,349 A 3/1987 Heiler (Continued)

OTHER PUBLICATIONS

Sports Unlimited Inc. Football Shoulder Pads, <www.sportsunlimitedinc.com>. Date: Copyright 1998-2012.

(Continued)

*Primary Examiner* — Khoa Huynh
*Assistant Examiner* — Anna Kinsaul
(74) *Attorney, Agent, or Firm* — Jansson Munger McKinley & Shape Ltd.

(57) ABSTRACT

Protective garments for use by an infant caregiver are shown and described. In an embodiment, a protective garment includes a body for wearing over a caregiver's shoulders and upper torso and at least two soft epaulets on shoulder regions of the body. Exemplary protective garments very generally have an appearance creating the impression of an athletic shoulder pad and can be worn by a sports-enthusiast caregiver while viewing a sporting event and holding an infant. An infant's head may rest against the epaulets proving comfort for both the infant and caregiver. The epaulets and protective garment generally protect a caregiver from contact by any material which may be discharged from the infant, for example during burping of the infant. It is preferred that a pair of epaulets are provided for each left and right shoulder region in embodiments in which the protective garments generally have an appearance of football-type athletic shoulder pads.

29 Claims, 9 Drawing Sheets

(56) References Cited

U.S. PATENT DOCUMENTS

| | | | | | |
|---|---|---|---|---|---|
| D298,365 | S | | 11/1988 | Acerbis | |
| 4,873,725 | A | * | 10/1989 | Mitchell | 2/48 |
| 4,989,265 | A | | 2/1991 | Nipper et al. | |
| 5,008,960 | A | | 4/1991 | Hemming | |
| D317,368 | S | | 6/1991 | Henson | |
| 5,054,121 | A | | 10/1991 | Mitchell | |
| 5,063,941 | A | | 11/1991 | White | |
| D329,508 | S | | 9/1992 | Fair | |
| 5,146,621 | A | | 9/1992 | Hadar et al. | |
| 5,390,368 | A | | 2/1995 | Chang | |
| 5,459,877 | A | | 10/1995 | Roberti | |
| 5,570,474 | A | | 11/1996 | Berry et al. | |
| 5,573,153 | A | | 11/1996 | Stillman | |
| D382,091 | S | * | 8/1997 | Leahy | D2/823 |
| 5,709,000 | A | * | 1/1998 | Hansen et al. | 5/655 |
| 5,802,610 | A | | 9/1998 | Burr | |
| 5,956,762 | A | | 9/1999 | Adams | |
| 5,960,471 | A | | 10/1999 | Burton | |
| 6,067,665 | A | | 5/2000 | DePalma et al. | |
| 6,175,967 | B1 | | 1/2001 | Donzis | |
| 6,182,290 | B1 | | 2/2001 | Morris | |
| 6,202,214 | B1 | | 3/2001 | Light | |
| 6,247,188 | B1 | | 6/2001 | Beland | |
| 6,327,712 | B1 | | 12/2001 | Armstrong et al. | |
| 6,345,392 | B1 | | 2/2002 | Rios | |
| D457,025 | S | | 5/2002 | Davy | |
| 6,484,325 | B1 | | 11/2002 | Lazarus et al. | |
| 6,678,895 | B1 | | 1/2004 | Grilliot et al. | |
| D492,819 | S | | 7/2004 | Beland | |
| 6,990,686 | B2 | | 1/2006 | Palmer | |
| 7,000,274 | B2 | | 2/2006 | Matthews Brown et al. | |
| 7,013,497 | B1 | | 3/2006 | Grant | |
| 7,082,617 | B1 | * | 8/2006 | Poindexter et al. | 2/48 |
| 7,146,663 | B2 | | 12/2006 | Brown et al. | |
| D549,967 | S | | 9/2007 | Wing | |
| D553,299 | S | * | 10/2007 | Le Carpentier | D29/101.2 |
| 7,290,303 | B2 | | 11/2007 | Mead et al. | |
| 7,316,035 | B2 | | 1/2008 | Archambault | |
| 7,406,718 | B2 | | 8/2008 | Ekelund et al. | |
| 7,409,727 | B2 | | 8/2008 | Ekelund et al. | |
| 7,451,508 | B2 | | 11/2008 | Matthews Brown et al. | |
| 7,454,808 | B2 | | 11/2008 | Parrilla | |
| D585,631 | S | | 2/2009 | Barclay | |
| D606,261 | S | | 12/2009 | Tobergte | |
| 7,624,461 | B2 | | 12/2009 | Tidwell et al. | |
| 7,640,598 | B1 | | 1/2010 | Mallik | |
| 7,640,600 | B2 | | 1/2010 | Reder | |
| D611,682 | S | | 3/2010 | Cutler | |
| 7,765,609 | B2 | * | 8/2010 | Chase | 2/46 |
| 7,784,108 | B2 | | 8/2010 | Ekelund et al. | |
| D623,383 | S | | 9/2010 | Rojas | |
| 7,797,760 | B2 | | 9/2010 | Morrow et al. | |
| 7,805,770 | B2 | | 10/2010 | Ekelund et al. | |
| 7,805,771 | B2 | | 10/2010 | Ekelund et al. | |
| D627,951 | S | | 11/2010 | Chesal et al. | |
| D636,152 | S | | 4/2011 | Wilson Watkins et al. | |
| 7,962,968 | B2 | | 6/2011 | Kordecki | |
| 7,992,220 | B1 | | 8/2011 | McGoldrick | |
| D649,291 | S | | 11/2011 | Cappuccio | |
| D684,725 | S | | 6/2013 | Kuever et al. | |
| D684,726 | S | | 6/2013 | Kuever et al. | |
| D684,727 | S | | 6/2013 | Kuever et al. | |
| 2004/0025220 | A1 | | 2/2004 | Palmer | |
| 2005/0066405 | A1 | | 3/2005 | Babiak | |
| 2005/0079327 | A1 | | 4/2005 | Stiles | |
| 2005/0132462 | A1 | | 6/2005 | Archambault | |
| 2008/0201815 | A1 | | 8/2008 | Barclay | |
| 2008/0263740 | A1 | | 10/2008 | Wright et al. | |
| 2009/0089910 | A1 | | 4/2009 | Lopez | |
| 2010/0293693 | A1 | | 11/2010 | Lee | |

OTHER PUBLICATIONS

The Mad Max Guide to Football Shoulder Pads, <www.madmaxcostumes.com/pads.htm>. Date: Feb. 17, 2012.

Riddell, EVX Shoulder Pads, <www.riddell.com/shop/evx>. Date: Feb. 17, 2012.

Sports Authority, Shoulder Pads, <www.sportsauthority.com>. Date: Nov. 23, 2011.

OC Family, BurbieBlocker, <www.ocfamily.com>>. Date: Feb. 2010.

* cited by examiner

INFANT CAREGIVER PROTECTIVE GARMENT HAVING AN ATHLETIC SHOULDER PAD APPEARANCE

CROSS REFERENCE TO RELATED APPLICATION

This patent application claims the benefit of U.S. Provisional Patent Application Ser. No. 61/636,235 filed Apr. 20, 2012. U.S. Provisional Patent Application Ser. No. 61/636,235 is incorporated herein by reference in its entirety to provide continuity of disclosure.

FIELD

The field relates to infant caregiver protective garments and, more specifically, to infant caregiver protective garments having the appearance of an athletic shoulder pad.

BACKGROUND

It is routinely necessary for an infant caregiver to hold, or cradle, an infant with the caregiver's arms and body and to gently, but securely, hold the infant. During this cradling, the infant's head and neck typically rest over and against the caregiver's shoulder while the infant's torso rests against the caregiver's chest. FIGS. 2 and 3 illustrate an infant being cradled by an infant caregiver. Cradling and gentle rocking of an infant are commonly undertaken by the caregiver to assist the infant with food digestion after feeding. And, gentle cradling of the infant by the caregiver may calm the infant and help the infant with sleep.

In order to cradle the infant in a manner most comfortable for the infant, it is important that the infant's body be protected from contact with hard objects that may be worn by the caregiver. Also for the infant's comfort, it is desirable that the infant rest against a soft, cushioned surface when being held by the caregiver.

From the caregiver's perspective, it is important that the caregiver is both comfortable while cradling the infant and that the caregiver is protected from contact with any undigested food, bile or other material that might be discharged from the infant's mouth, particularly after feeding. For example, the caregiver will typically cradle the infant after feeding to assist the infant with food digestion. The caregiver will attempt to gently rock the infant and pat the infant's back in an effort to "burp" the infant to release digestive gasses from the infant's stomach. The process of burping the infant can result in discharge of food, bile and other material from the infant's mouth and onto the caregiver. Such discharged material can undesirably soil the caregiver's clothing and can come into contact with the infant thereby making the infant uncomfortable and requiring that the infant be washed.

While various garments and cloths exist to assist the caregiver in cradling an infant, such garments and cloths may not be as effective as possible in both providing comfort for the infant and caregiver and in protecting the caregiver from contact with materials that might be discharged from the infant's mouth. Moreover, such garments in particular may be perceived by men as maternity-type products more suitable for use by women. And, women may perceive such maternity-type garments as unfashionable.

It would be an advance in the art to provide an infant caregiver protective garment which would improve the comfort of an infant cradled by the caregiver, which would be comfortable to wear by the caregiver, which would protect the caregiver from contact with materials that might be discharged by the infant and which would be perceived by the caregiver and others as an attractive and fashionable garment.

SUMMARY

Protective garments for use by an infant caregiver are shown and described herein. Exemplary protective garments very generally have an appearance creating the impression of an athletic shoulder pad. As just one example of use, the exemplary protective garments could be worn by a sports-enthusiast caregiver while viewing a sporting event and holding an infant. Protective garments may be enjoyable and attractive to wear and comfortable for both an infant and infant caregiver, all while protecting the caregiver and infant from contact with any substances which might be discharged from the infant.

In embodiments, a protective garment comprises a body for wearing over a caregiver's shoulders and upper torso and at least two soft epaulets, or pads, each overlying one of the right and left shoulder regions. Preferably, the body comprises a back portion of soft material and right and left front portions of soft material. Preferably, each front portion meets the back portion to provide right and left shoulder regions and the back and front portions form a neck opening and right and left outer arm openings.

In embodiments, each epaulet preferably has an upper surface of soft material and is secured with respect to the body overlying one of the right and left shoulder regions. In embodiments generally resembling certain football-type athletic shoulder pads, the epaulets may include a pair of epaulets overlying each of the right and left shoulder regions, each pair of epaulets including an inner epaulet closer to the neck opening and an outer epaulet closer to the arm opening. In embodiments, the inner epaulet at least partially overlies the outer epaulet. The body preferably defines an upright axis and the epaulets are symmetrical about the axis like the epaulet arrangement of certain football-type athletic shoulder pads.

Preferably, the inner and outer epaulets are secured with respect to the body by at least one fastener. The at least one fastener may be selected from the group consisting of thread, at least one hook-and-loop fastener and combinations thereof. Epaulets may be permanently and/or removably secured with respect to the body which can facilitate cleaning of the protective garment.

In embodiments, each of the inner and outer epaulets includes a plurality of layers. Layering provides an opportunity to construct or build up the epaulets to have a three-dimensional appearance like that of an athletic shoulder pad epaulet. In certain embodiments, two, three, four or more layers may be provided based on the material selected for each layer and appearance desired.

Indicia may be provided on the protective garment to enhance the protective garment's appearance and to customize the protective garment for the owner. Such indicia may include, for example, team colors, team logos, player names and player numbers.

Other aspects of infant caregiver protective garments are described and illustrated herein.

BRIEF DESCRIPTION OF THE DRAWINGS

Examples of infant caregiver protective garments having the appearance of an athletic shoulder pad may be understood by reference to the following description taken in conjunction with the accompanying drawings, in which like reference numerals identify like elements throughout the different views. In certain of the drawings, broken lines are provided to illustrate certain hidden elements to facilitate understanding. The drawings are not necessarily to scale, emphasis instead being placed upon illustrating the principles of the invention. In the accompanying

DRAWINGS

Figure 1:
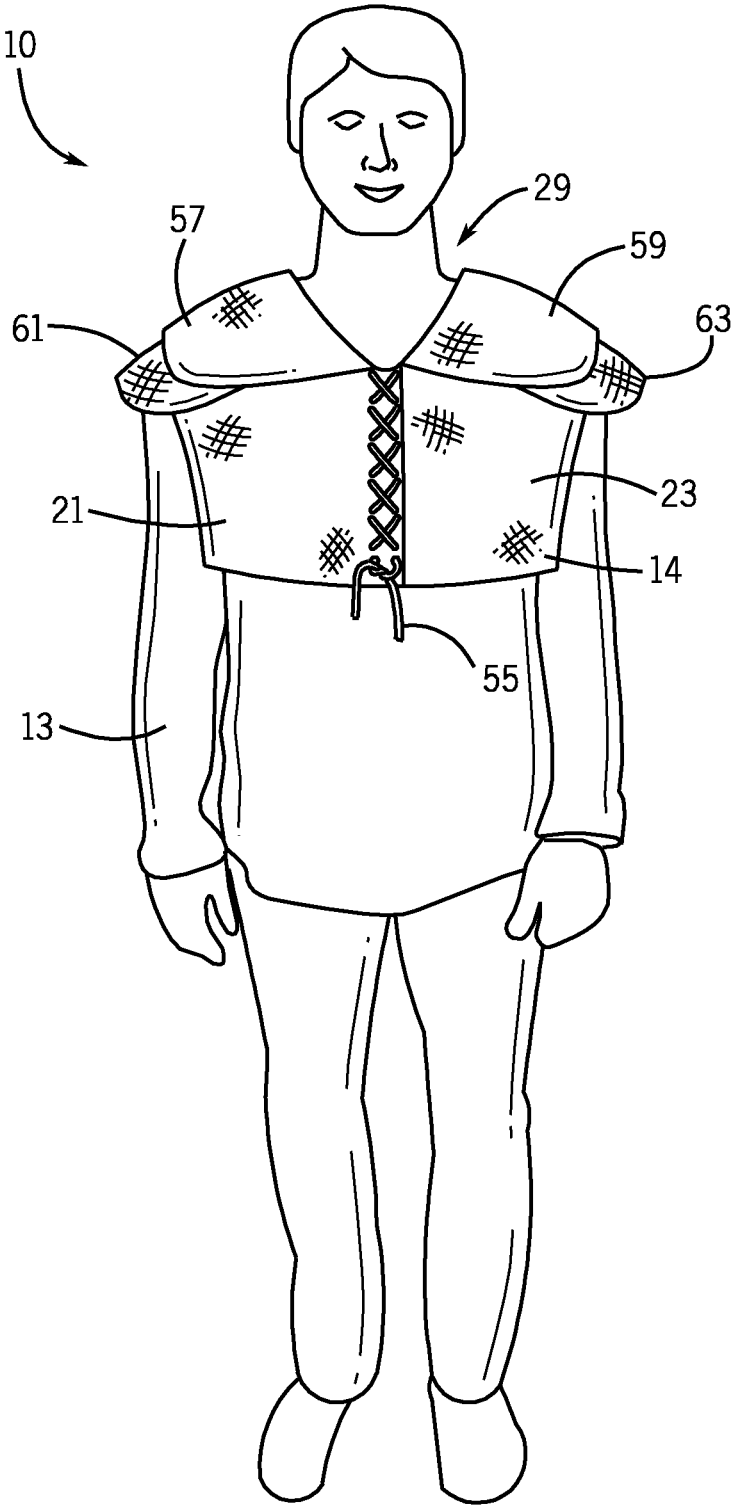
Figure 3:
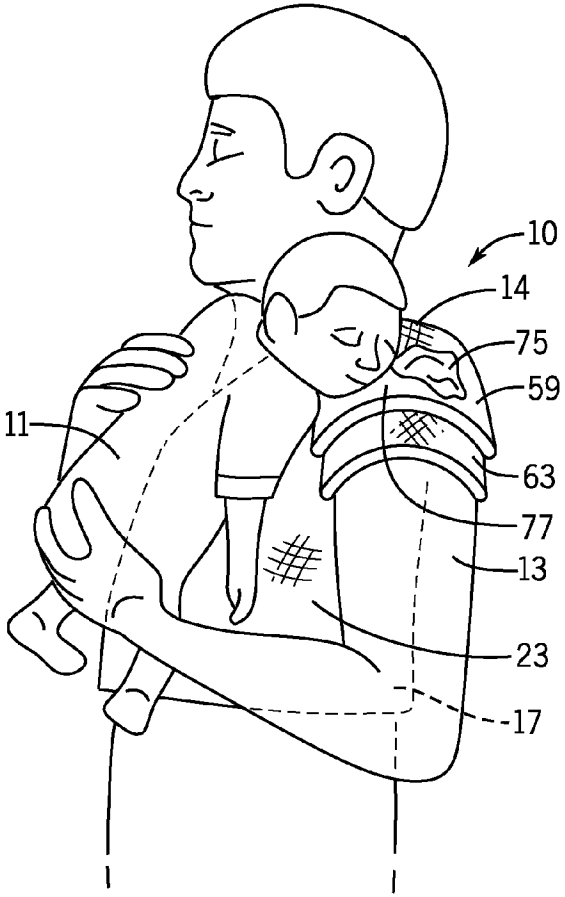
Figure 2:
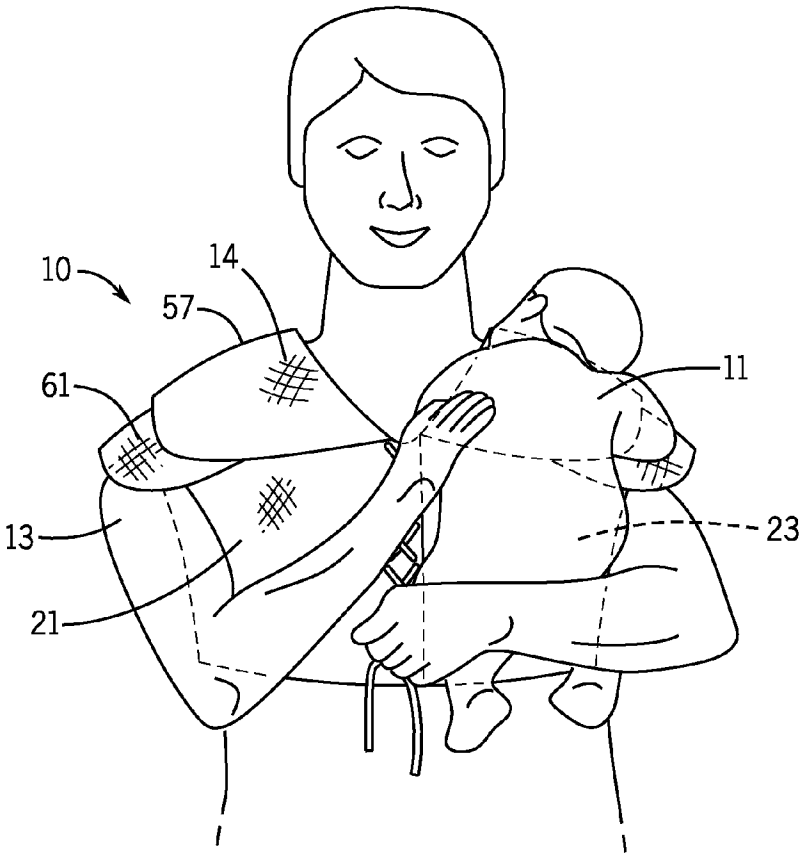
Figure 4:
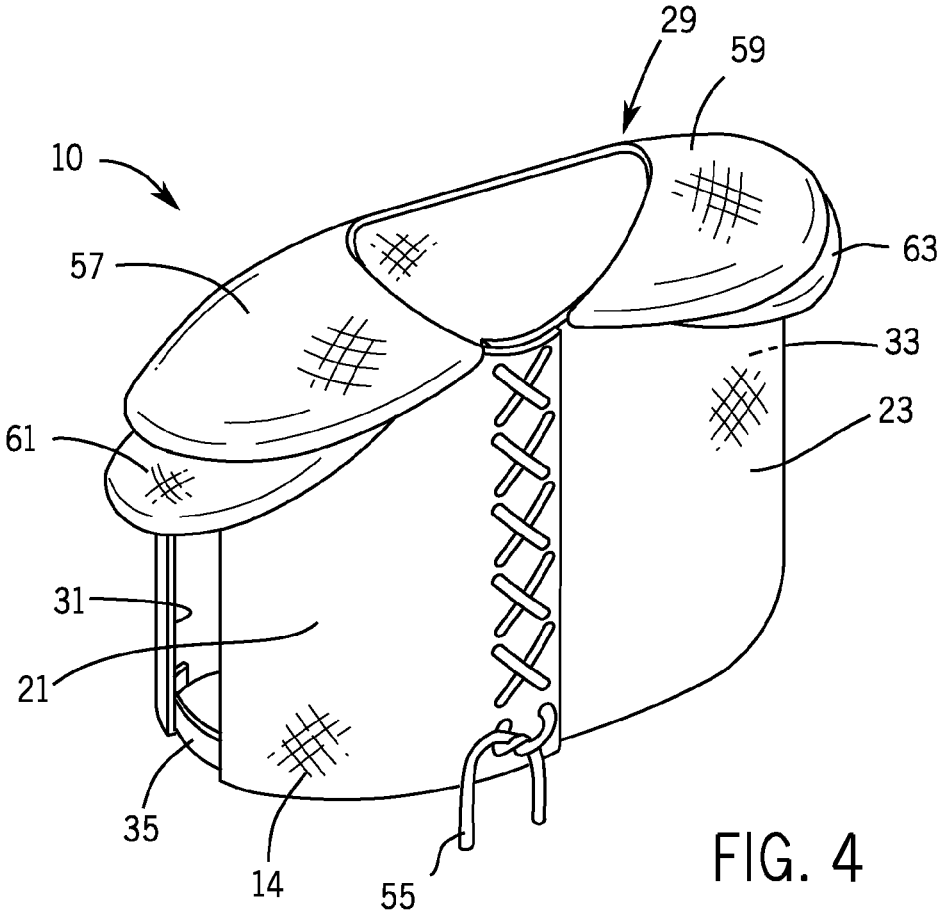
Figure 5:
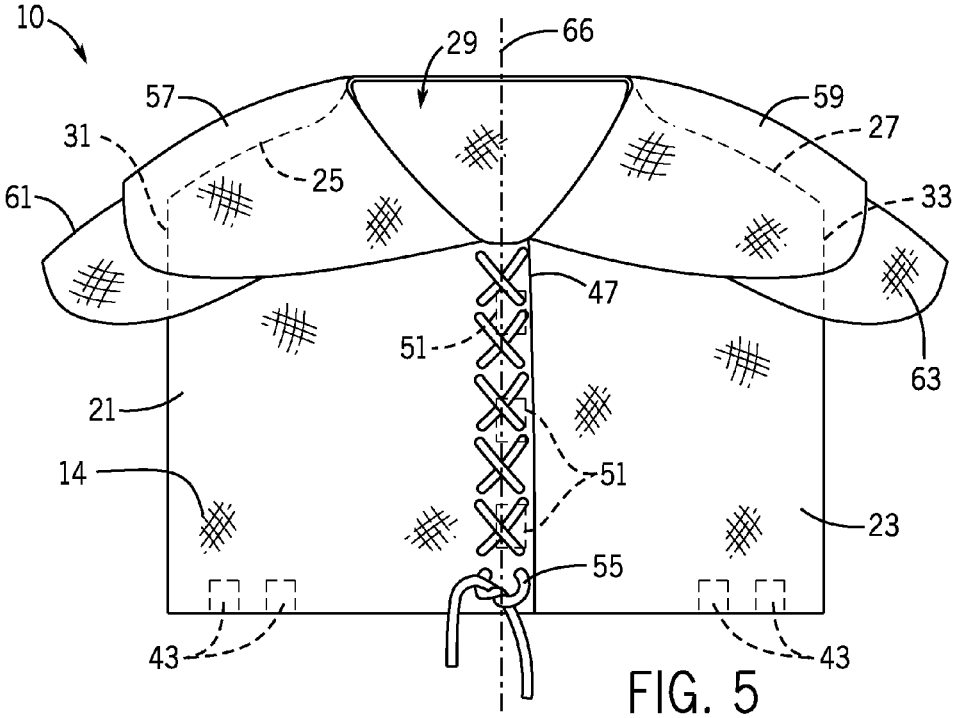
Figure 6:
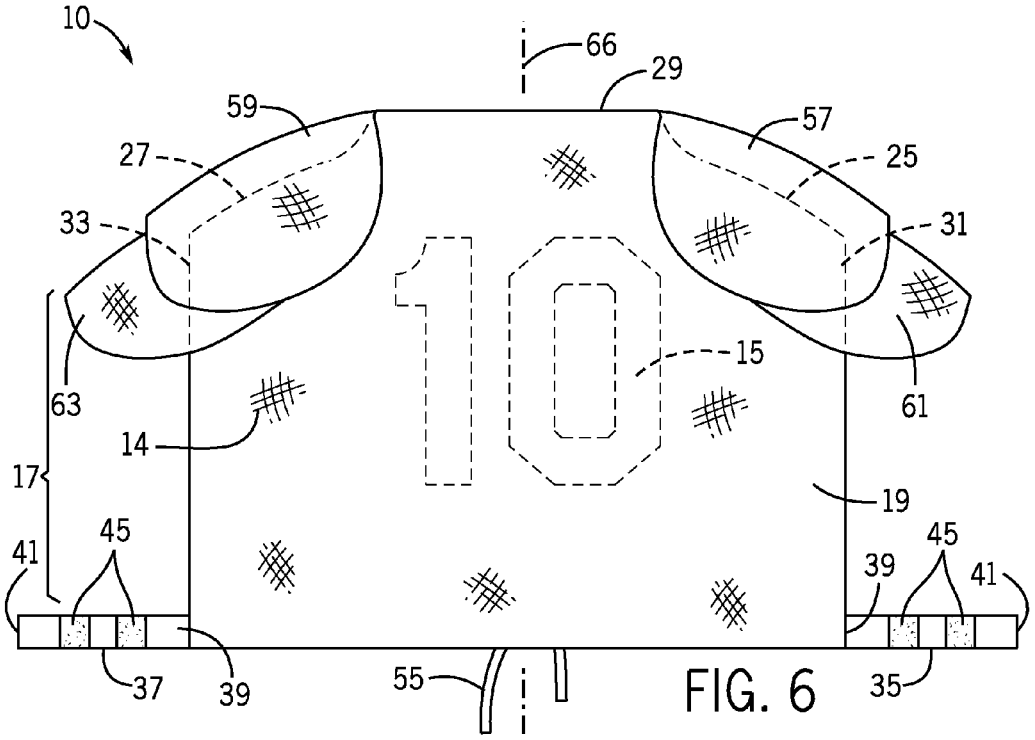
Figure 7:
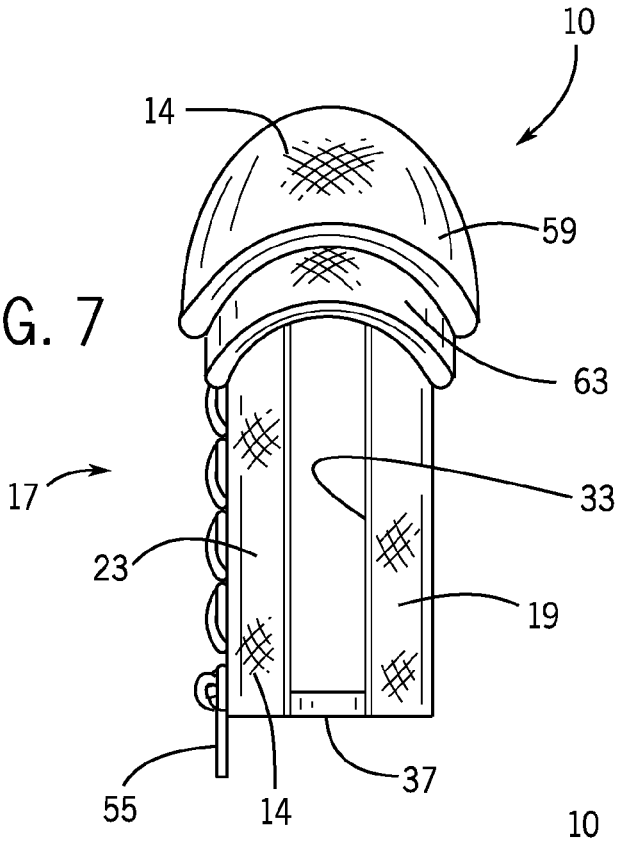
Figure 8:
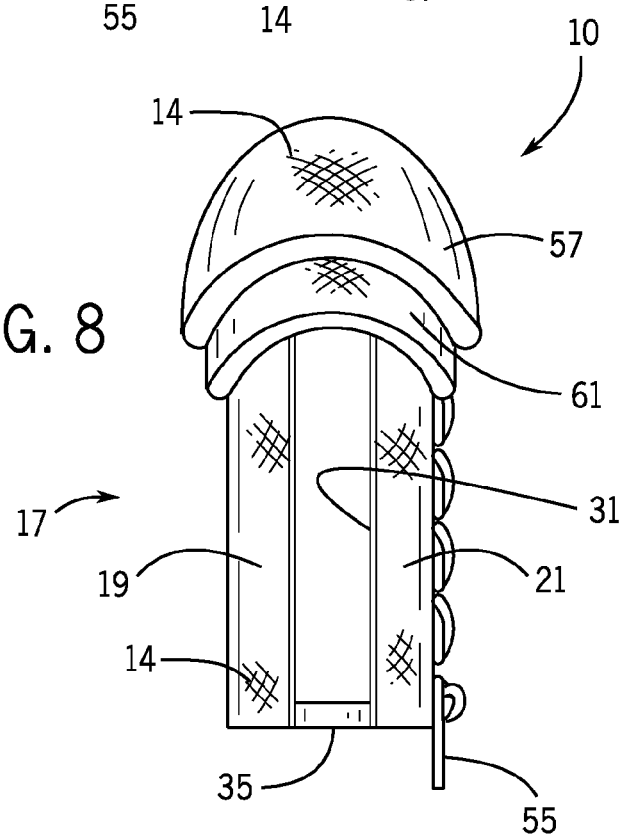
Figure 9:
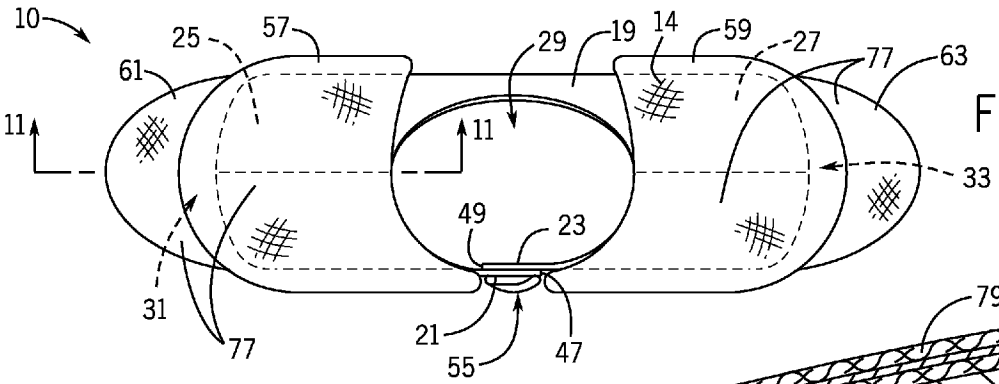
Figure 11:
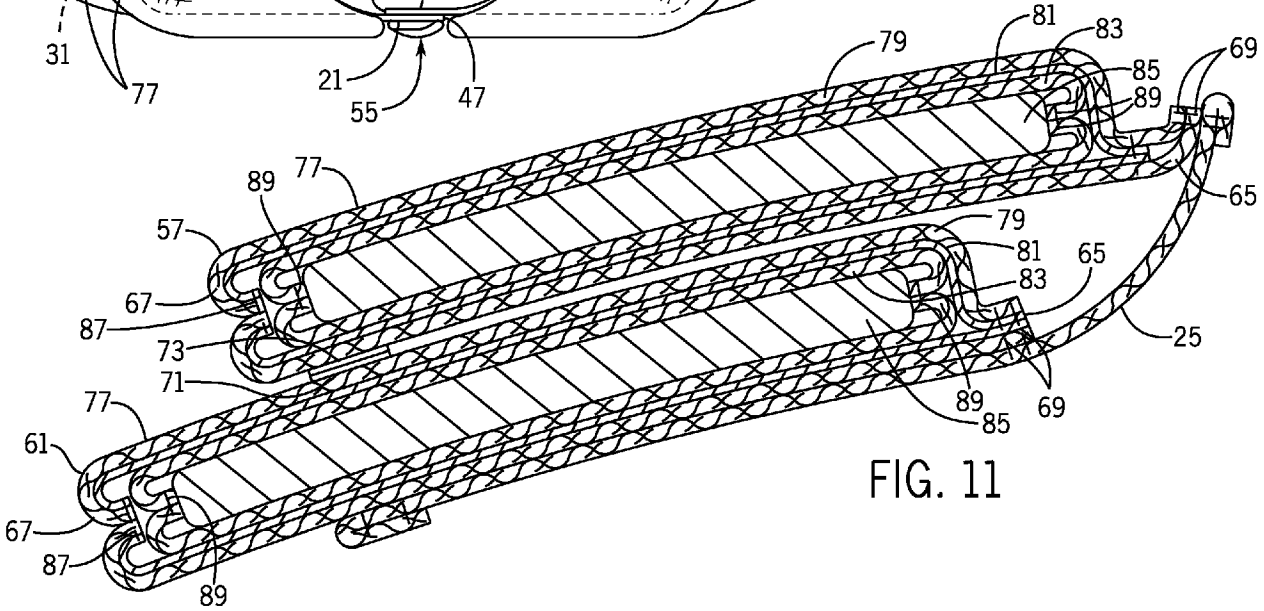
Figure 10:
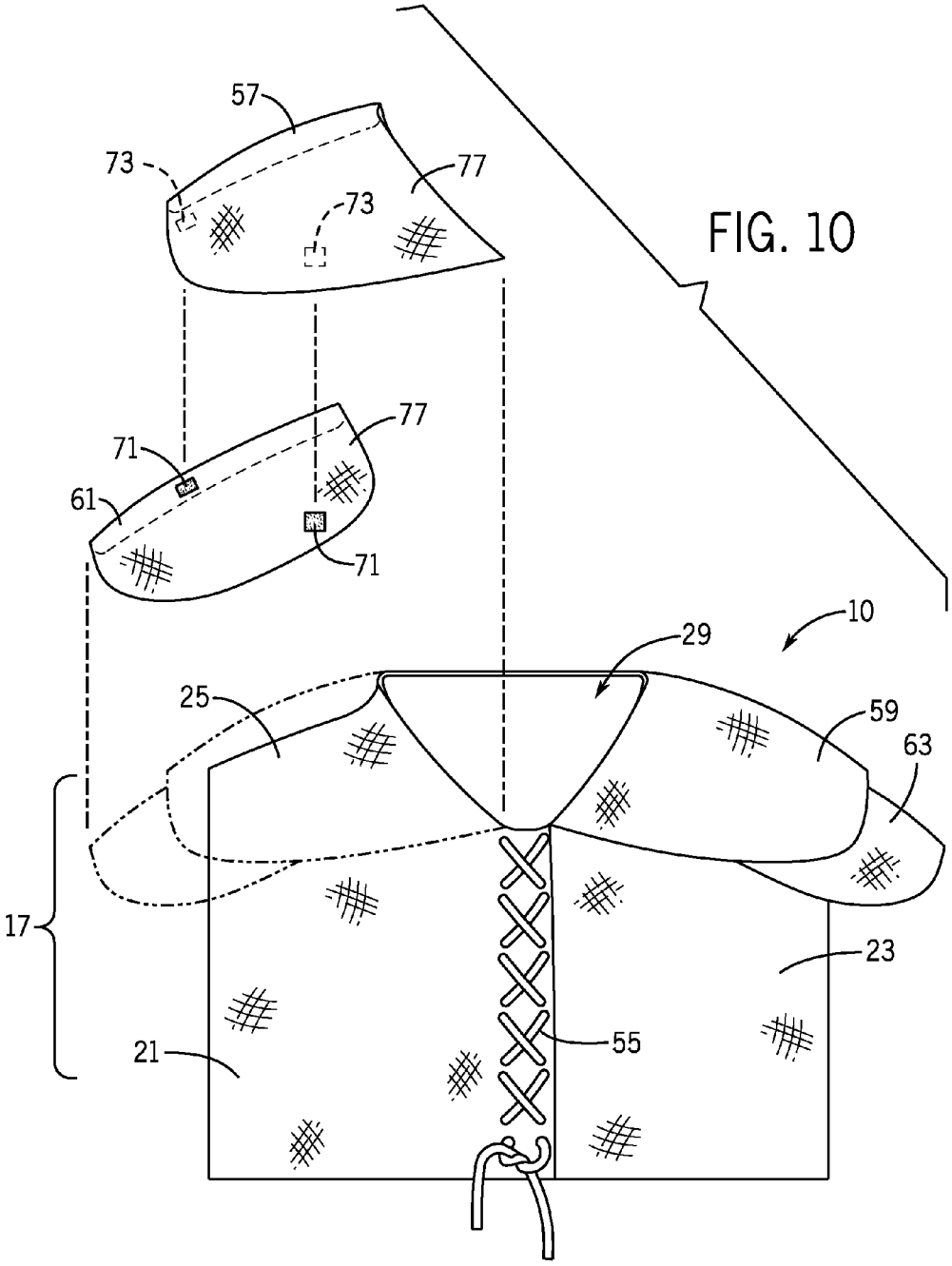
Figure 12:
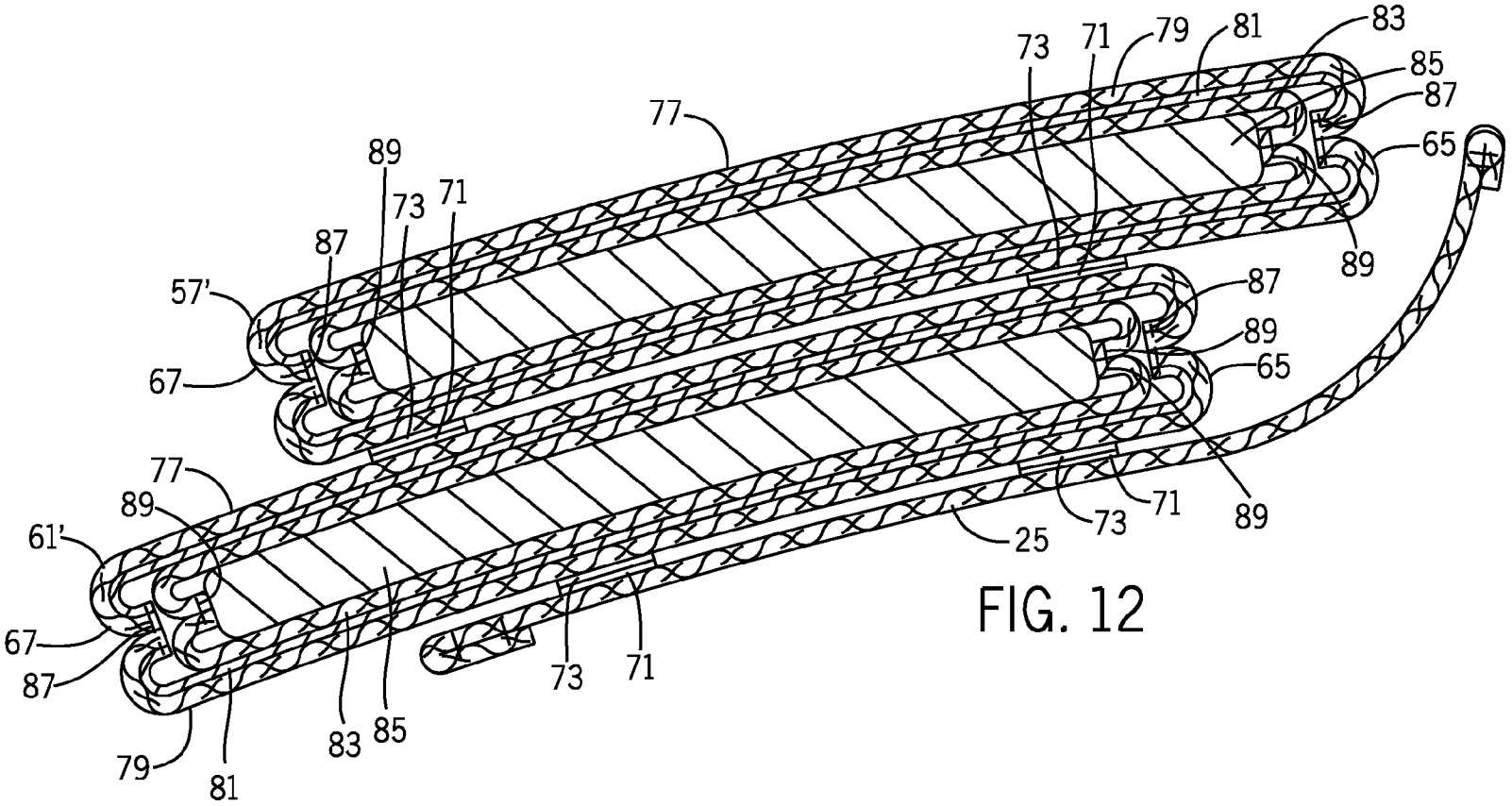
Figure 13:
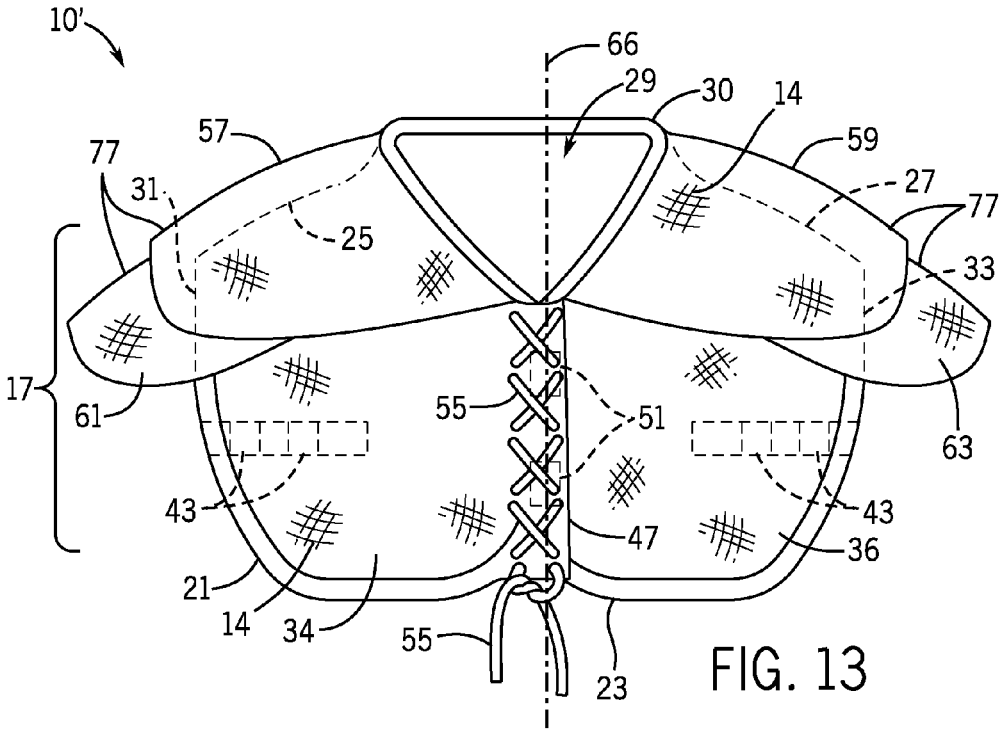
Figure 14:
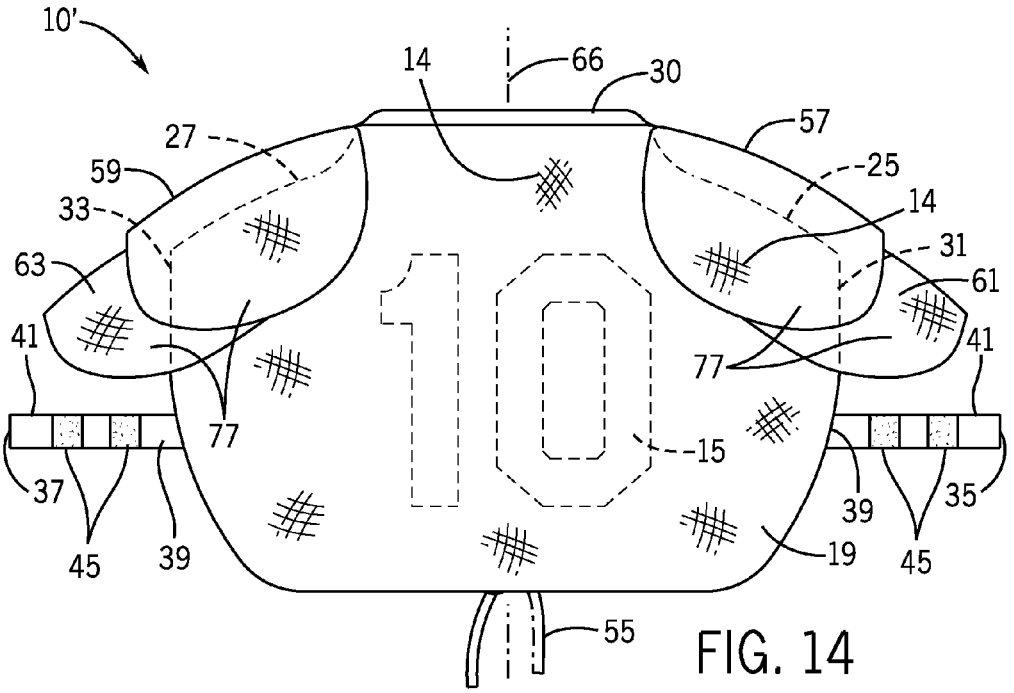

FIG. 1 is a front view of an exemplary protective garment and an infant caregiver wearing the protective garment;

FIG. 2 is a front view showing use of the exemplary protective garment of FIG. 1 and an infant cradled by the infant caregiver;

FIG. 3 is a side view showing use of the exemplary protective garment of FIG. 1 and an infant cradled by the infant caregiver;

FIG. 4 is a perspective view of the exemplary protective garment of FIG. 1;

FIG. 5 is a front elevation view of the exemplary protective garment of FIG. 1;

FIG. 6 is a rear elevation view of the exemplary protective garment of FIG. 1;

FIG. 7 is a left side elevation view of the exemplary protective garment of FIG. 1;

FIG. 8 is a right side elevation view of the exemplary protective garment of FIG. 1;

FIG. 9 is a top plan view of the exemplary protective garment of FIG. 1;

FIG. 10 is a partially exploded view of the exemplary protective garment of FIG. 1;

FIG. 11 is a section view of exemplary epaulets and a right side shoulder portion taken along section 11-11 of FIG. 9;

FIG. 12 is a section view of a further embodiment of exemplary epaulets and a right side shoulder portion taken along a section such as section 11-11 of FIG. 9;

FIG. 13 is a front elevation view of another exemplary protective garment embodiment for wearing by an infant caregiver; and FIG. 14 is a rear elevation view of the exemplary protective garment of FIG. 13.

DETAILED DESCRIPTION

Referring first to FIGS. 1-11, there is shown one embodiment of an infant caregiver protective garment 10. FIGS. 13-14 illustrate a further embodiment of an infant caregiver protective garment 10'. Exemplary protective garments 10, 10' are provided with an ornamental appearance very generally resembling that of an athletic shoulder pad. For convenience and brevity, like reference numbers are used for parts shared by protective garments 10, 10'.

The exemplary protective garments 10, 10' provide comfort and protection for the infant 11 and infant caregiver 13. Exemplary protective garments 10, 10' preferably include soft, non-rigid materials which are comfortable to the touch of infant 11 and caregiver 13. The crisscross surface indicia 14 are indicative of soft, non-rigid materials.

The ornamental appearance of each protective garment 10, 10' as being generally like that of an athletic shoulder pad would be attractive to both male and female "sports fan" caregivers 13 with infant children. Exemplary protective garments 10, 10' could, for example, be worn by a caregiver 13 while simultaneously cradling an infant 11 and watching a sporting event on television. Protective garments 10, 10' combine the novelty of wearing a piece of "athletic equipment" like players of the sporting event with improved infant 11 care and protection for the caregiver 13. The fashion and attractiveness of exemplary protective garments 10, 10' may be enhanced by customization of the protective garments 10, 10' to include indicia 15 (FIGS. 6, 14), such as team colors, team logos, player names and player numbers.

As used herein, "athletic shoulder pad" means or refers to the appearance of the entire protective garment 10, 10', rather than to an individual part or pad of the protective garments 10, 10'. While protective garments 10, 10' are each illustrated as having an ornamental appearance somewhat resembling a shoulder pad of the type worn by a football player, it should be understood that protective garments 10, 10' may be made to very generally resemble other types of athletic shoulder pads. By way of example only, protective garments 10, 10' may be made to somewhat resemble an athletic shoulder pad worn by an ice hockey player. As described herein, the general structure of an athletic shoulder pad is well suited for use as an infant caregiver protective garment 10, 10'.

Referring now to FIGS. 1-11 and 13-14, each protective garment 10, 10' comprises a body 17, or vest, which is worn over the caregiver's 13 shoulders and upper torso. Exemplary body 17 very generally provides the ornamental appearance of arch portions of an athletic shoulder pad. Body 17 comprises a back portion 19 and right and left front portions 21, 23. Portions 19, 21 and 23 may be thought of as panels of the protective garment 10, 10'. Each front portion 21, 23 meets back portion 19 to provide right and left shoulder regions 25, 27 which rest on the caregiver's 13 shoulders when worn.

Back 19 and front portions 21, 23 further define and form a neck opening 29 and right and left outer arm openings 31, 33. The caregiver's 13 neck fits through neck opening 29 and the caregiver's 10, 10' right and left arms fit through a respective arm opening 31, 33 when the protective garment 10, 10' is worn. In the examples, back portion 19 and right and left front portions 21, 23 are separated beneath the right and left outer arm openings 31, 33.

As illustrated in FIGS. 13-14, the exemplary protective garment 10' neck opening 29 may further include an ornamental neck roll 30. Neck roll 30 very generally creates the impression of a football-type athletic shoulder pad neck roll.

Referring further to FIGS. 13-14, front portions 21, 23 may optionally include an ornamental soft overlying panel 34, 36 secured over front portions 21, 23 by stitching, adhesive or any suitable form of attachment. In the example, overlying panels 34, 36 are smaller than a respective front portion 21, 23 and very generally create the impression of a football-type shoulder pad arch while the portions of front portions 21, 23 extending beyond overlying panels 34, 36 create a very general impression of football-type shoulder pad arch padding.

Back portion 19 and right and left front portions 21, 23 and optional overlying panels 34, 36 are made of any suitable soft material. As used herein, "soft" means or refers to a material which yields readily to touch or pressure and is not rigid or stiff. Use of a soft material for back 19, and right and left front portions 21, 23 provides a comfortable surface which is pleasing to the infant 11 when held or cradled by caregiver 13. Preferably, the soft material is a woven, knitted or felted material. Representative soft materials may include natural and synthetic materials. By way of example only, representative soft materials may include cotton cloth, diaper cloth, cotton velour, polyester, polyester fleece, suede cloth, rayon, nylon, micro fleece and combinations thereof. Various types of weaving may be utilized. For example, the cotton cloth or diaper cloth may have a bird's-eye dobby weave containing very small diamonds in the weaving to resemble a "bird's eye."

Persons of skill in the art will appreciate that diaper cloth is a well-known material used for manufacture of cloth diapers. Diaper cloth is commonly made of cotton material (as much as 100% cotton content) and may include two or more plies. Two-ply diaper cloth is a particularly useful grade of diaper cloth capable of use in the manufacture of body 17. Diaper cloth may be a bird's eye weave material woven from small, fine yarns which creates a very soft and comfortable material. Diaper cloth is lightweight, absorptive, fast drying, strong, durable, pleasing and comfortable to the touch and may be dyed easily to provide a desired color.

As illustrated in FIGS. 6-8 and 14, body 17 may further include right and left straps 35, 37 extending between back portion 19 and right and left front portions 21, 23 for securing body 17 to a caregiver 13. If provided, straps 35, 37 have front and rear ends 39, 41. In the examples, one end (e.g., rear end 41) is fixedly attached to back portion 19 of body 17 and the other end (e.g., front end 39) is removably attached to a corresponding front portion 21, 23 of body 17 by a suitable fastener that permits connection and disconnection of the strap 35, 37. Preferably, the fastener comprises a hook-and-loop fastener 43, 45, but other suitable fasteners such as buttons, snaps and cooperating rings may be utilized to secure straps 35, 37 to body 17. In the examples of FIGS. 5-8 and 13-14, the rear end 41 of each strap 35, 37 is permanently (i.e., fixedly) attached to body 17 rear portion 19 by means of any suitable fastener such as thread, a button, a rivet, a staple, a snap and combinations thereof.

To assist the caregiver 13 in donning (i.e., to put on) protective garment 10, 10', the right and left front portions 21, 23 may be capable of being separated, or opened, to enable the caregiver's torso to fit between right and left portions 21, 23. In such embodiments, right and left front portions 21, 23 are separated along respective inner edges 47, 49 to permit spreading and opening of right and left front portions 21, 23.

To hold right and left front portions 21, 23 together once garment 10, 10' is donned, a suitable fastener or fasteners permitting opening and closing of right and left front portions 21, 23 may be provided. Preferably, the fastener comprises a hook-and-loop fastener (collectively indicated by 51 in FIGS. 5 and 13) but other suitable fasteners such as buttons, snaps, laces and combinations thereof may be utilized to hold right and left front portions 21, 23 together once the protective garment 10, 10' is donned by the caregiver 13. In the examples, laces 55 threaded through grommets (not shown) in right front portion 21 are ornamental. In other embodiments, laces 55 could serve as the fasteners used to close right and left front portions 21, 23 and to hold right and left front portions 21, 23 together. In such embodiments, laces 55 could be threaded through and between grommets (not shown) in both the right and left front portions 21, 23 to hold right and left portions 21, 23 together, much as the upper part of a shoe (i.e., the vamp) is laced together.

Referring to FIGS. 1-14, epaulets 57, 59, 61, 63 are secured with respect to body 17 overlying one of the right and left shoulder regions 25, 27. Two pair 57, 61 and 59, 63 of epaulets are illustrated to provide an appearance somewhat like that of a football-type athletic shoulder pad. Epaulets 57, 59 are referred to herein as "inner epaulets" because inner epaulets 57, 59 are arranged closer to neck opening 29 than are epaulets 61, 63 which are referred to herein as "outer epaulets." In the examples, each epaulet 57, 59, 61, 63 is an elongate type of pad and has an inner end 65 closest to neck opening 29 and an outer end 67 closest to one of the outer arm openings 31, 33. In the examples, each epaulet 57, 59, 61, 63 extends away from neck opening 29. Preferably, each inner epaulet 57, 59 at least partially overlies a respective outer epaulet 61, 63 and outer epaulets 61, 63 extend beyond (i.e., overhang) a respective one of the outer arm openings 31, 33. Preferably, body 17 defines an upright axis 66 and epaulets 57, 59, 61, 63 are symmetrical laterally about axis 66 as illustrated in FIGS. 1, 5-6 and 13-14. Such lateral symmetry further creates the impression of athletic shoulder pads which are also symmetrical to provide protection for a player equally on both the right and left sides of the shoulder pad.

As used herein, "epaulet" means or refers to a piece of material, or pad, overlying shoulder region 25, 27 of body 17. In the example, inner epaulets 57, 59 have a general ornamental appearance somewhat like that of football-type shoulder pad shoulder-covering plates and outer epaulets 61, 63 each have a general ornamental appearance somewhat like that of football-type shoulder pad deltoid-covering caps or cups. At least two epaulets are required, one on each shoulder region 25, 27, to provide the appearance of an athletic shoulder pad. More than two epaulets may be provided on each shoulder region 25, 27.

Referring to FIGS. 6-8 and 11-12, epaulets 57, 59, 61, 63 overlie a respective shoulder region 25, 27 and have a curvature which generally follows and wraps around the curvature of the caregiver's 13 shoulders. As shown in FIGS. 1-8, 10, and 13-14, exemplary epaulets 57, 59, 61, 63 extend over an upper part of back portion 19 and an upper part of front portions 21, 23, again very generally providing an ornamental appearance somewhat like that of a football-type athletic shoulder pad.

Referring to FIGS. 9-12, epaulets 57, 59, 61, 63 may be fixedly or removably secured with respect to body 17 by means of a suitable fastener. The example of FIGS. 9-11 illustrate an embodiment in which each epaulet 57, 59, 61, 63 is fixedly secured with respect to body 17. As illustrated in FIG. 11, each epaulet inner end 65 may be stitched with thread 69 to body 17 and, as illustrated in FIGS. 10-11, may be further secured with respect to body 17 with a hook-and-loop fastener 71, 73. Use of a fastener permitting separation of epaulets, such as a hook-and-loop fastener 71, 73, would facilitate access to the epaulets 57, 59, 61, 63 for cleaning. Other suitable fasteners to secure epaulets 57, 59, 61, 63 with respect to body 17 may include a button, a rivet, a staple a snap, a lace and combinations thereof.

The example of FIG. 12 illustrates another embodiment in which each epaulet 57', 61' is removably secured with respect to body 17. In the embodiment illustrated in FIG. 12, the epaulets represented by reference numbers 57', 61' are removably secured with respect to body 17 entirely by hook-and-loop fasteners 71, 73. The unshown epaulets overlying shoulder region 27 could be secured to body 17 in the same manner. Other suitable fasteners to removably secure epaulets (e.g., epaulets 57', 61') with respect to body 17 may include a button, a snap, a lace and combinations thereof. An advantage of removably secured epaulets (e.g., epaulets 57', 61') is that the epaulets can be completely removed from body 17 and washed separately from body 17. For example, the epaulets (e.g., epaulets 57', 61') could be placed in a washing machine for washing separate from body 17 to provide for thorough automatic cleaning.

The relationship of exemplary epaulets 57, 59, 61, 63 with a respective shoulder region 25, 27 make epaulets 57, 59, 61, 63 ideal for comfortable support of an infant's 11 head and neck on the caregiver's 13 shoulder as illustrated in FIGS. 2-3. Such relationship includes the overlying relationship of epaulets 57, 59, 61, 63 with a respective shoulder region 25, 27, the curvature of epaulets 57, 59, 61, 63 about the caregiver's 13 shoulder and the extension of epaulets 57, 59, 61, 63 over the upper parts of back portion 19 and front portions 21, 23. In addition, the preferred overlying relationship of epaulets 57, 59, 61, 63 and the epaulet 57, 59, 61, 63 relationship with shoulder regions 25, 27 of body 17 position epaulets 57, 59, 61, 63 and body 17 as a broad multi-layered barrier to any food, bile or other material 75 (FIG. 3) which may be discharged from the infant's 11 mouth during burping or cradling of infant 11 by caregiver 13.

The exemplary construction of epaulets 57, 59, 61, 63 also make exemplary epaulets 57, 59, 61, 63 ideal for use in comfortably cradling an infant 11 by a caregiver 13 with the infant's 11 head and neck on the caregiver's 13 shoulder. As illustrated in FIGS. 1-14, each epaulet 57, 59, 61, 63 is of a soft material and has an upper surface 77 providing a cushioned pillow-like support on which the infant's 11 head can rest comfortably. Such exemplary epaulet 57, 59, 61, 63 structure further distributes the weight of infant 11 on caregiver 13 making it more comfortable for caregiver 13 to hold infant 11, particularly over an extended amount of time.

Preferably each of the inner 57, 61 and outer 59, 63 epaulets includes a plurality of layers. Reference will now be made to FIGS. 11 and 12 which are section views of epaulets 57, 61 and 57', 61', it being understood that the description of epaulets 57, 61 would apply to epaulets 59 and 63 and the description of epaulets 57', 61' would apply to mirror image epaulets (not shown) overlying the opposite shoulder region 27. In the examples of FIGS. 11-12, epaulets 57, 61 and 57', 61' each include four layers, but fewer or more layers may be provided. In the examples, exemplary epaulets 57, 59, 61, 63 and epaulets 57', 61' comprise a first or outer layer 79 (which includes upper surface 77), a second or inner layer 81 adjacent and inside of the outer layer 79, a third or outer padding layer 83 adjacent and inside of the second layer 81 and a fourth or inner padding layer 85 adjacent and inside of the third layer 83.

As illustrated in the examples of FIGS. 11-12, the first or outer layer 79 completely surrounds layers 81, 83 and 85, inner layer 81 completely surrounds layers 83 and 85 and the third or outer padding layer 83 completely surrounds the fourth or inner padding layer 85. Second and third layers 81 and 83 are intermediate outer layer 79 and fourth layer 85 in the examples. While this surrounding or concentric relationship of layers 79, 81, 83, 85 is preferred, persons of skill in the art will appreciate that other types of layered relationships may be provided. For example, each layer may simply rest upon another layer with no surrounding relationship. Each successive layer would be inside of the other. And, each layer may be of material folded onto itself.

The layers 79, 81, 83, 85 may be stitched together along the periphery of each epaulet 57, 59, 61, 63 and 57', 61' or as otherwise desired (as in a quilt) to provide discrete, modular epaulets 57, 59, 61, 63 as illustrated, for example, in FIG. 10. If surrounding layers are utilized, each layer 79, 81, 83 may be stitched to itself with stitching 87, 89 to form a type of case or sack in which each inner layer is located as illustrated in FIGS. 11-12.

In the examples, each layer 79, 81, 83, 85 is preferably of a soft material as previously defined. Use of layers of soft material provides a comfortable cushioned surface for contact by infant 11 when held or cradled by caregiver 13 and provides a complete barrier between caregiver 13 and any food, bile or other material 75 which may be discharged from the infant's 11 mouth. Use of plural layers, such as layers 79, 81, 83, 85, represents an improvement over single layer arrangements of prior garments and cloths which provide less cushioning for an infant 11 and may provide an incomplete barrier to food, bile and other materials 75 between the infant 11 and caregiver 13. Further, use of layers as described permits epaulets 57, 59, 61, 63 and 57', 61' to be quilted or built up with plural joined-together layers to provide a three-dimensional appearance more akin to football-type athletic shoulder pads than a single sheet of material.

Use of soft materials for each epaulet 57, 59, 61, 63 and 57', 61' further provides for a protective garment 10, 10' which is flexible and drapes easily over the caregiver's 13 shoulders and torso and is comfortable to wear by the caregiver 13 when cradling an infant 11. This is unlike the case with an actual athletic shoulder pad which would be far more rigid and restrictive of movement by the caregiver 13 and would include hard surfaces unsuitable for contact by an infant 11.

Preferably, the soft material used for layers 79, 81, 83, 85 (FIGS. 11-12) is a woven, knitted or felted material and may include combinations thereof. Such material for layers 79, 81, 83, 85 may be natural or synthetic. A wide range of materials and pads may be utilized based on the needs of the caregiver 13.

By way of non-limiting example only, an exemplary first or outer layer 79 may comprise diaper cloth, cotton cloth, cotton velour, organic cotton cloth, terry cloth, flannel, chenille, polyester cloth, polyester fleece, sherpa, felt, suede cloth, rayon, nylon and micro fleece. Combinations of these exemplary materials, and other materials, may be utilized. Diaper cloth is a particularly preferred material for outer layer 79 because such material is very comfortable and pleasing to the touch for both infant 11 and caregiver 13 as previously described. The absorptive and breathability properties of diaper cloth helps to wick moisture away from infant 11, thereby keeping infant 11 comfortable. Two-ply diaper cloth is highly preferred for use as outer layer 79.

With respect to second or inner layer 81, that layer 81 may comprise, without limitation, diaper cloth, bamboo and cotton blend batting (a blend of the two materials), cotton batting, soy blend batting, hemp, cotton-polyester blends, polyester cloth. Combinations of such exemplary materials may be utilized as desired.

Bamboo and cotton blend batting is a particularly preferred material for inner layer 81. As is also known to those of skill in the art, bamboo and cotton batting may comprise a combination of bamboo fiber and cotton. Bamboo and cotton blend batting is available, for example, in grades comprising 50-60% bamboo fiber and 40-50% cotton fiber, although other grades may be used. Bamboo and cotton blend batting is an ideal fabric for use in manufacture of multi-layer garments. Bamboo and cotton batting is easy to work with and is available in sheet form. Bamboo and cotton blend batting is absorbent, soft, breathable and lightweight. The softness of bamboo and cotton batting yields ideal comfort for an infant 11 and for a caregiver 13. In addition, bamboo and cotton batting has desirable thermal properties meaning that the material wicks away moisture from the body in warmer temperatures, while providing warmth for an infant 11 resting against or near such material in cooler temperatures. Bamboo and cotton batting has excellent wicking properties generally which is advantageous to wick any food, bile or other material 75 on epaulet 57, 59, 61, 63 and 57', 61' inward and away from and out of contact with infant 11 and caregiver 13. Bamboo and cotton blend batting further has natural anti-microbial properties which can be desirable to maintain hygiene for both infant 11 and caregiver 13.

Turning next to exemplary third or outer padding layer 83, that outer padding layer 83 may comprise, without limitation, diaper cloth, cotton cloth, organic cotton, sherpa, bamboo and cotton blend batting, polyester cloth. Outer padding layer 83 is not limited to any single material and combinations of the foregoing materials, and other materials, may be provided. Diaper cloth including two-ply diaper cloth, is a preferred material for outer padding layer 83 because the soft properties of such material provide excellent cushioning and comfort for the infant 11.

Exemplary fourth or inner padding layer 85 may comprise, without limitation, polyester padding. It is desirable that inner padding layer 85, or another layer 79, 81, 83, include a low-density padding with compressive and rebound properties to provide additional cushioning and three-dimensionality to facilitate production of epaulets 57, 59, 61, 63 and 57', 61' that have the general appearance of athletic shoulder pads.

It has been surprisingly found that wicking of any discharged food, bile or other material 75 into epaulets 57, 59, 61, 63 and 57', 61' and away from the infant's 11 head and body can be improved through the combination of layering of epaulets 57, 59, 61, 63 and 57', 61' and use of certain material combinations. This wicking effect helps keeps epaulets 57, 59, 61, 63 and 57', 61' drier so that infant 11 can rest comfortably on an epaulet 57, 59, 61, 63 and 57', 61' during cradling and holding by caregiver 13.

Specifically, it has been found that the use of diaper cloth for outer layer 79 and use of bamboo and cotton blend batting for the inner layer 81 are highly absorptive and are quite effective at wicking food, bile and other materials 75, especially of a liquid type, away from an epaulet upper surface 77 and into the affected epaulet 57, 59, 61, 63 and 57', 61'. Two-ply diaper cloth is particularly preferred in such embodiments of outer layer 79. The bamboo and cotton blend fabric attracts and retains liquid-type food, bile and other material 75, keeping such materials away from an infant 11 and caregiver 13. This wicking effect further serves to protect the caregiver 13 from contact with the food, bile and other materials 75. An outer padding layer 83 of highly-preferred diaper cloth can also facilitate this wicking effect, helping to move liquid-type food, bile and other materials 75 further from the infant 11.

Use of a highly-preferred polyester padding for inner padding layer 85 provides a highly effective barrier which generally prevents movement of any food, bile and other materials 75 toward caregiver 13, thereby protecting the caregiver's 13 clothing from being soiled. Thus, the highly-preferred combination of layers 79, 81, 83 and 85 and the respective materials provides epaulets 57, 59, 61, 63 and 57', 61' for garments 10, 10' which are both comfortable and protective for both the infant 11 and caregiver 13.

The appearance of protective garment 10, 10' generally as an athletic shoulder pad may be enhanced by use of certain preferred materials. For example, cotton diaper cloth exhibits excellent drapeability and the supple and flexible characteristics of the diaper cloth material when combined with bamboo and cotton blend batting and polyester padding allow for the layering of the epaulets 57, 59, 61, 63 and 57', 61' to take on the shape of epaulets used for an athletic shoulder pad. The combination of diaper cloth, bamboo and cotton blend batting and polyester padding used in the layers of the epaulets 57, 59, 61, 63 and 57', 61' combine to improve the handle, appearance and performance of the epaulets.

From the foregoing it may be clearly understood that the exemplary protective garments 10, 10' effectively eliminate the possibility that food, bile and other material 75 discharged by an infant 11 cradled and held by caregiver 13 will contact and soil the caregiver's 13 clothing and body. And, unlike actual athletic shoulder pads, exemplary protective garments 10, 10' are comfortable to wear by the caregiver 13. The general appearance of the exemplary protective garments 10, 10' as athletic shoulder pads provides a fun and novel way for sports fan caregivers 13 to both view a sporting event and care for an infant 11.

It can also be understood that exemplary protective garments 10, 10' provide the opportunity to improve infant 11 comfort. The soft and broad cushions and ample upper surfaces 77 of exemplary epaulets 57, 59, 61, 63 provide surfaces ideally comfortable for resting of an infant's 11 head and neck while cradled by caregiver 13 for burping or just for holding. Infant 11 comfort may be further improved by selection of materials for epaulets 57, 59, 61, 63 which wick away from the infant 11 any discharged food, bile or other material 75. Thus, epaulets 57, 59, 61, 63 also protect the infant 11.

While the principles of this invention have been described in connection with specific embodiments, it should be understood clearly that these descriptions are made only by way of example and are not intended to limit the scope of the invention.

What is claimed is:

1. A protective garment for use by an infant caregiver, comprising:

a body for wearing over a caregiver's shoulders and upper torso including:

a back portion of soft material; and right and left front portions of soft material, each front portion meeting the back portion to provide right and left shoulder regions, the back and front portions forming a neck opening and right and left outer arm openings; and at least a pair of soft epaulets secured with respect to each of the left and right shoulder regions of the body, each epaulet having a low-density material with compressive and rebound properties and a soft upper surface such that the epaulet provides a cushioned and soft resting surface, one of each pair of soft epaulets being sized to overlie one of the right or left shoulder regions from about the neck opening to the arm opening, and one of each pair of soft epaulets being an outer epaulet closer to the arm opening and the other of each pair of soft epaulets being an inner epaulet closer to the neck opening which at least partially overlies the outer epaulet, whereby the protective garment for the infant caregiver has an appearance of an athletic shoulder pad.

2. The protective garment of claim 1 wherein the inner and outer epaulets are secured with respect to the body by at least one fastener.

3. The protective garment of claim 2 wherein the at least one fastener is selected from the group consisting of thread, at least one hook-and-loop fastener and combinations thereof.

4. The protective garment of claim 1 wherein the body defines an upright axis and the epaulets overlying the right shoulder region and the epaulets overlying the left shoulder region are symmetrical about the axis.

5. The protective garment of claim 4 wherein each of the inner and outer epaulets includes a plurality of layers.

6. The protective garment of claim 5 wherein each of the inner and outer epaulets includes a first layer and the soft upper surface of each epaulet is along the first layer.

7. The protective garment of claim 6 wherein the first layer is a material selected from the group consisting of diaper cloth, two-ply diaper cloth, cotton cloth, cotton velour, organic cotton cloth, terry cloth, flannel, chenille, polyester cloth, polyester fleece, sherpa, felt, suede cloth, rayon, nylon, micro fleece and combinations thereof.

8. The protective garment of claim 7 further comprising a second layer adjacent and inside the first layer.

9. The protective garment of claim 8 wherein the second layer is a material selected from the group consisting of diaper cloth, bamboo and cotton blend batting, cotton batting, soy blend batting, hemp, cotton-polyester blends, polyester cloth and combinations thereof.

10. The protective garment of claim 9 further comprising a third layer adjacent and inside the second layer.

11. The protective garment of claim 10 wherein the third layer is selected from the group consisting of diaper cloth, cotton cloth, organic cotton, sherpa, bamboo and cotton blend batting, polyester cloth and combinations thereof.

12. The protective garment of claim 11 further comprising a fourth layer adjacent and inside the third layer and the fourth layer includes the low density-material.

13. The protective garment of claim 12 wherein the fourth layer is polyester padding.

14. The protective garment of claim 4 wherein the back portion and the right and left front portions are separated beneath the right and left outer arm openings and the body further includes right and left straps extending between the back portion and the right and left front portions for securing the body to a wearer.

15. The protective garment of claim 14 wherein the straps have front and rear ends and one end is fixedly attached to the body and the other end is removably attached to the body.

16. The protective garment of claim 4 wherein the right and left front portions are separated along respective inner edges and the body further includes a fastener which removably secures together the right and left front portions.

17. The protective garment of claim 16 wherein the fastener is selected from the group consisting of a hook-and-loop fastener, a button, a snap, laces and combinations thereof.

18. The protective garment of claim 4 further comprising indicia on the protective garment.

19. A protective garment for use by an infant caregiver, comprising:

a body for wearing over a caregiver's shoulders and upper torso including:

a back portion of soft material; and right and left front portions of soft material, each front portion meeting the back portion to provide right and left shoulder regions, the back and front portions forming a neck opening and right and left outer arm openings; and a pair of soft epaulets on each of the respective right and left shoulder regions overlying the respective right or left shoulder region from about the neck opening to the arm opening, each pair of epaulets including an outer epaulet closer to the arm opening and an inner epaulet closer to the neck opening which at least partially overlies the outer epaulet, each of the epaulets having an upper surface of soft material and a plurality of layers including at least one layer comprising padding, whereby the protective garment for the infant caregiver has an appearance of an athletic shoulder pad.

20. The protective garment of claim 19 wherein, for each epaulet, an outermost layer of the plurality of layers surrounds the padding.

21. The protective garment of claim 19 wherein the soft material of the epaulet upper surfaces comprises a fluid-absorbent material.

22. A protective garment for use by an infant caregiver, comprising:

a body for wearing over a caregiver's shoulders and upper torso, the body having:

a back portion of soft material; and right and left front portions of soft material, each front portion meeting the back portion to provide right and left shoulder regions, the back and front portions forming a neck opening and right and left outer arm openings; and at least a pair of soft pads overlying each of the right and left shoulder regions, one of each pair of soft pads having an elongate dimension extending away from about the neck opening continuously to at least the arm opening across an upper part of the shoulder region where the front and back portions meet, and one of each pair of soft pads being an outer pad closer to the arm opening and the other of each pair of soft pads being an inner pad closer to the neck opening which at least partially overlies the outer pad, each pad having a plurality of layers including at least a soft outer layer and a soft inner padding layer of a low-density material with compressive and rebound properties such that each pad provides a cushioned resting surface, whereby the protective garment for the infant caregiver has an appearance of an athletic shoulder pad.

23. The protective garment of claim 22, wherein each of the soft pads comprises a soft epaulet.

24. The protective garment of claim 23 wherein the body defines an upright axis and the pairs of soft epaulets overlying each of the right and left shoulder regions are symmetrical about the axis.

25. The protective garment of claim 24 wherein the soft outer layer is a material selected from the group consisting of diaper cloth, two-ply diaper cloth, cotton cloth, cotton velour, organic cotton cloth, terry cloth, flannel, chenille, polyester cloth, polyester fleece, sherpa, felt, suede cloth, rayon, nylon, micro fleece and combinations thereof.

26. The protective garment of claim 24 further including at least one layer between the soft outer layer and the soft inner padding layer, the at least one layer being of a material selected from the group consisting of diaper cloth, bamboo and cotton blend batting, cotton batting, soy blend batting, hemp, cotton-polyester blends, polyester cloth and combinations thereof.

27. The protective garment of claim 26 wherein the at least one layer between the soft outer layer and the soft inner padding layer is a second layer and the protective garment further comprises a third layer between the second layer and the soft inner padding layer, the third layer being a material selected from the group consisting of diaper cloth, bamboo and cotton blend batting, cotton batting, soy blend batting, hemp, cotton-polyester blends, polyester cloth and combinations thereof.

28. The protective garment of claim 22 wherein the soft inner padding layer is a material including polyester padding.

29. The protective garment of claim 24 further comprising indicia on the protective garment.

* * * * *